United States Patent [19]

Sato et al.

[11] Patent Number: 4,890,987

[45] Date of Patent: Jan. 2, 1990

[54] SCROLL TYPE COMPRESSOR WITH SEAL SUPPORTING ANTI-WEAR PLATE PORTIONS

[75] Inventors: Tadashi Sato; Atsushi Mabe, both of Gunma, Japan

[73] Assignee: Sanden Corporation, Gunma, Japan

[21] Appl. No.: 170,300

[22] Filed: Mar. 18, 1988

[30] Foreign Application Priority Data

Mar. 20, 1987 [JP] Japan ..... 62-67353

[51] Int. Cl.[4] ..... F04B 49/02; F04C 18/04; F04C 27/00

[52] U.S. Cl. ..... 417/310; 418/55; 418/178

[58] Field of Search ..... 418/55, 142, 178, 15, 418/55 R, 55 C, 55 A; 417/310; 277/204

[56] References Cited

U.S. PATENT DOCUMENTS

| | | | |
|---|---|---|---|
| 801,182 | 10/1905 | Creux | 418/55 A |
| 2,924,178 | 2/1960 | Hogan | 418/15 |
| 4,216,661 | 8/1980 | Tojo et al. | 62/505 |
| 4,382,370 | 5/1983 | Suefuji et al. | 62/324.1 |
| 4,383,805 | 5/1983 | Teegarden et al. | 417/308 |
| 4,432,708 | 2/1984 | Hiraga et al. | 418/55 R |
| 4,437,820 | 3/1984 | Terauchi et al. | 418/55 C |
| 4,468,178 | 8/1984 | Hiraga et al. | 417/440 |
| 4,498,852 | 2/1985 | Hiraga | 418/55 |
| 4,505,651 | 3/1985 | Terauchi et al. | 417/440 |
| 4,514,150 | 4/1985 | Hiraga et al. | 418/55 X |
| 4,540,355 | 9/1985 | Sakaki et al. | 418/55 |
| 4,642,034 | 2/1987 | Terauchi | 417/295 |
| 4,645,436 | 2/1987 | Sakamoto | 418/55 |

FOREIGN PATENT DOCUMENTS

| | | |
|---|---|---|
| 56-147386 | 6/1981 | Japan . |
| 57-148088 | 9/1982 | Japan . |

*Primary Examiner*—John J. Vrablik
*Assistant Examiner*—Leonard P. Walnoha
*Attorney, Agent, or Firm*—Banner, Birch, McKie & Beckett

[57] ABSTRACT

A scroll type compressor is disclosed which includes a housing with an inner chamber and fluid inlet and outlet ports connected to the inner chamber. A fixed scroll, which is mounted within the housing, has an end plate from which a first spiral wrap extends. An orbiting scroll also is mounted within the housing for orbital motion with respect to the fixed scroll. The orbiting scroll has an end plate from which a second spiral wrap extends; and the first and second wraps interfit to define at least one pair of sealed off fluid pockets. The end plate of the fixed scroll partitions the inner chamber of the housing into a suction chamber and rear chamber. The end plate of the fixed scroll has at least one pair of holes for adjusting the displacement of the compressor. A control mechanism selectively controls fluid communication through the holes. The axial end surface of the second wrap is provided with a seal element which forms an axial seal between the second wrap and the end plate of the fixed scroll. An anti-wear plate is disposed on the end surface of the fixed end plate to prevent from friction between the seal element and end surface of the end plate. The anti-wear plate has cut-out portions facing the holes. Each cut-out portion has a predetermined shape and area to prevent cutting of the seal element and to minimize pressure loss.

18 Claims, 4 Drawing Sheets

SCROLL TYPE COMPRESSOR WITH SEAL SUPPORTING ANTI-WEAR PLATE PORTIONS

TECHNICAL FIELD

This invention relates to a scroll type compressor, and more particularly, to a scroll type compressor for an automobile air conditioning system which includes a mechanism for adjusting the displacement of the compressor.

BACKGROUND OF THE INVENTION

Scroll type fluid displacement apparatus are well known in the prior art. For example, U.S. Pat. No. 801,182 issued to Creux discloses such an apparatus which includes two scrolls, each having a circular end plate and a spiroidal or involute spiral element. The scrolls are maintained angularly and radially offset so that both spiral elements interfit to form a plurality of line contacts between their spiral curved surfaces to thereby seal off and define at least one pair of fluid pockets. The relative orbital motion of the two scrolls shifts the line contacts along the spiral curved surfaces and, as a result, the volume of the fluid pockets increases or decreases, dependent on the direction to the orbital motion. Thus, a scroll type fluid displacement apparatus may be used to compress, expand or pump fluids.

Scroll type fluid displacement apparatus are suitable for use as refrigerant compressors in building air conditioners. In such building air conditioners, thermal control of a room, or control of the air conditioner, is generally accomplished by intermittent operation of the compressor because capacity control mechanisms usually are not provided for the compressors of such air conditioners. Though the energy required for maintaining the room at the desired temperature usually is not large once the desired temperature is first achieved, a relatively large load is required to drive the compressor, at least during initial intermittent operation of the compressor, and to a lesser extent upon each subsequent actuation of the compressor. This intermittent operation wastefully consumes large amounts of energy.

When conventional scroll type compressors are used in automobile air conditioners, these compressors usually are driven by the automobile engine through an electromagnetic clutch. Once the passenger compartment is cooled to the desired temperature, like building air conditioners, control of the output of the compressor usually is accomplished by intermittent operation of the compressor through the electromagnetic clutch. Since a relatively large load is required to drive the compressor, this large load is intermittently applied by the automobile engine. Accordingly, conventional scroll type compressors for automobile air conditioners also wastefully consume large amounts of energy in achieving and maintaining the desired temperature in the passenger compartment.

Recently, it was recognized that it is desirable to provide a scroll type compressor with a displacement or volume adjusting mechanism to control the compression ratio as operation demands. This has been accomplished by various mechanisms which control the volume of the sealed off pockets. Mechanisms to control the volume of the sealed off pockets generally have used a pair of holes through the end plate of one of the scrolls, with the pair of holes providing controlled communication to a chamber located on the opposite side of the scroll end plate. For example, in U.S. Pat. No. 4,468,178 issued on Aug. 28, 1984 to Masaharu Hiraga et al. the pair of holes provides communication to the suction chamber, while in U.S. Pat. No. 4,505,651 issued on Mar. 19, 1985 to Kiyoshi Terauchi et al. and U.S. Pat. No. 4,642,034 issued on Feb. 10, 1987 to Kiyoshi Terauchi, the pair of holes provides controlled communication to an intermediate chamber. In the compressors disclosed in these patents, axial tip seal elements are located along the axial ends of the wrap elements and have been placed in direct contact with facing end surface of the end plate of the opposing scroll. Also, the pairs of holes have been located and sized so that the tip seals do not pass over the edge of the holes.

The use of anti-wear plates to cover the end plate of a scroll member in a scroll type compressor, for the purpose of reducing friction between an axial tip-seal and the end plate, has also been disclosed in the prior art, e.g., in Japanese Utility Model Application Publication No. 56-147386. However, this prior art use of an antiwear plate was in a fixed displacement compressor without displacement adjusting holes. The inventors of the present application have experimented with the use of anti-wear plates in a variable displacement compressor such as shown in FIGS. 8, 9 and 10. The inventors discovered certain problems with the anti-wear plate constructions illustrated in FIGS. 8, 9 and 10, as discussed below, and overcame these problems with the anti-wear plate construction of the present invention.

Referring to FIG. 8, a portion of a scroll compressor with a displacement adjustment mechanism is illustrated. A plurality of holes, one of which, 275*a* is illustrated, are formed by drilling into end plate from the side opposite from which spiral element 272 extends. The holes are drilled at positions which overlap with the inner wall of spiral element 272 so that portions of the inner wall of spiral element 272 are removed.

A seal element 213 is placed in groove 283 in the axial end surface of spiral element 282 and forms an axial seal between the spiral element 282 and the front end surface of the end plate 271. The axial end surface of spiral element 282 is also provided with a seal element which forms an axial seal between the spiral element 272 and the front end surface of the other end plate. An anti-wear plate 38 is disposed on the front end surface of end plate 271.

Referring to FIGS. 8 and 9, the configuration of anti-wear plate 38 is shown. Anti-Wear plate 38 has a plurality of cut-out portions 305*a*', 305*b*', 306*a*' and 306*b*', each of which is located adjacent to and faces a respective one of the holes, such as hole 275*a* seen in FIG. 8. The configuration of each cut-out portion is semicircular. FIG. 8 illustrates the scroll members in the position when spiral element 282 completely overlaps each of the holes. In this position the top or deepest portion of each semicircular cut-out portion, which is illustrated in the sectional view of FIG. 8, is located such that the whole width of seal element 213 is exposed to the hole at the top of the cut-out, and a substantial portion of the tip seal overlaps the hole inward of the remaining portion of the cut-out.

The anti-wear plate disclosed in FIG. 8 prevents friction between the seal element and front surface of the end plate. However, since a substantial part of seal element extends over the hole by passing over the semicircular edge of the cut-out portion of antiwear plate, the seal element 213 tends to be bent toward hole 275*a* by high gas pressure of the fluid pockets which enters the gap between tip seal 213 and the walls of groove 283. The bending action is, particularly severe at the holes which are located in position nearest the scroll center. As a result the seal element is cut off by the edge of the cut-out portions of the anti-wear plate.

FIG. 10, illustrates an anti-wear plate construction which was tested to prevent above mentioned seal element cutting problem. In this construction, each semicircular cut-out portion of anti-wear plate 38 extends over more than a half of the width of the tip seal, i.e., past the radial center 215 of the seal element. But in this construction, the open area of the hole is decreased by the portion of the anti-wear plate extending over the hole. Pressure loss is thus increased when the compressor displacement is reduced by allowing fluid flow through the holes. As a result power consumption is increased.

SUMMARY OF THE INVENTION

It is a primary object of this invention in a scroll type compressor to prevent cutting off the axial tip seal element by the edge of holes in an anti-wear plate.

It is another object of this invention in a scroll type compressor to decrease pressure loss caused by an anti-wear plate extending over the hole of a displacement adjusting mechanism when the compressor displacement is reduced.

A scroll type compressor according to this invention includes a housing having a fluid inlet port and a fluid outlet port. A fixed scroll is fixedly disposed in the housing and has a circular end plate from which a first wrap extends. An orbiting scroll has a circular end plate from which a second wrap extends. The first and second wraps interfit at an angular and radial offset to form a plurality of line contacts to define at least one pair of sealed off fluid pockets. A driving mechanism is operatively connected to the orbiting scroll and effects orbital motion of the orbiting scroll by rotation of a drive shaft while rotation of the orbiting scroll is prevented by a rotation preventing device. As a result, the fluid pockets shift along the spiral curved surfaces of the wraps which change the volume of the fluid pockets.

According to the present invention, a displacement adjusting mechanism includes one of the end plates having at least one pair, and preferably two pairs, of holes formed therein, and a control mechanism to control the flow of fluid through the holes. The holes are placed in symmetrical positions so that the wrap of the other scroll simultaneously crosses over the holes. The holes connect the sealed off fluid pockets to a lower pressure area on the opposite side of the end plate, such as an intermediate pressure chamber. The axial end surface of the wrap of the other scroll is provided with a seal element which forms an axial seal between the wrap and the front end surface of the end plate of the one of the scrolls. An anti-wear plate is disposed on the front end surface of the end plate of the one scroll to prevent friction between the seal element and front end surface of the end plate. Additionally, the anti-wear plate is provided with cut-out portions adjacent the holes. Each cut-out portion has a predetermined area and configuration which disposes a sufficient area of the anti-plate over a respective hole to to prevent the seal element from bending into the hole and being cut off by edge of cut-out portions of the anti-wear plate, while also minimizing pressure loss through the holes when compressor displacement is reduced.

In one preferred embodiment, each cut-out portion has a longitudinal edge, such as a lengthwise edge of a rectangle, which extends completely across an adjacent hole. The longitudinal edge is located, when the wrap of the other scroll completely overlaps the adjacent hole, in the area between the center of the width of the seal element and the outermost edge of the seal element with respect to the portion of the wrap through which the adjacent hole is formed.

In another embodiment, each cut-out portion takes on the configuration of a plurality of spaced teeth. Another preferred aspect of the invention relates to forming two pairs of the holes in the end plate of the one scroll, with one of the pairs of holes being located closer to the center of the scrolls. When two pairs of holes are used, the longitudinal edge of the cut-out portions located adjacent the pair of holes closer to the center of the scrolls can be disposed closer to the center of the seal element than the longitudinal edge of the cutout portions located adjacent the other pair of holes. When the spaced-tooth configuration of cut-out portions is used with two pairs of holes, the area of the spacing between the teeth can be larger for the cut-out portions adjacent the pair of holes further from the scroll center than the area of the spacing between the teeth of the cut-out portions adjacent the other pair of holes.

Further objects, features and other aspects of this invention will be understood from the detailed description of the preferred embodiment of this invention with reference to the annexed drawings.

DETAILED DESCRIPTION OF THE INVENTION

Figure 1:
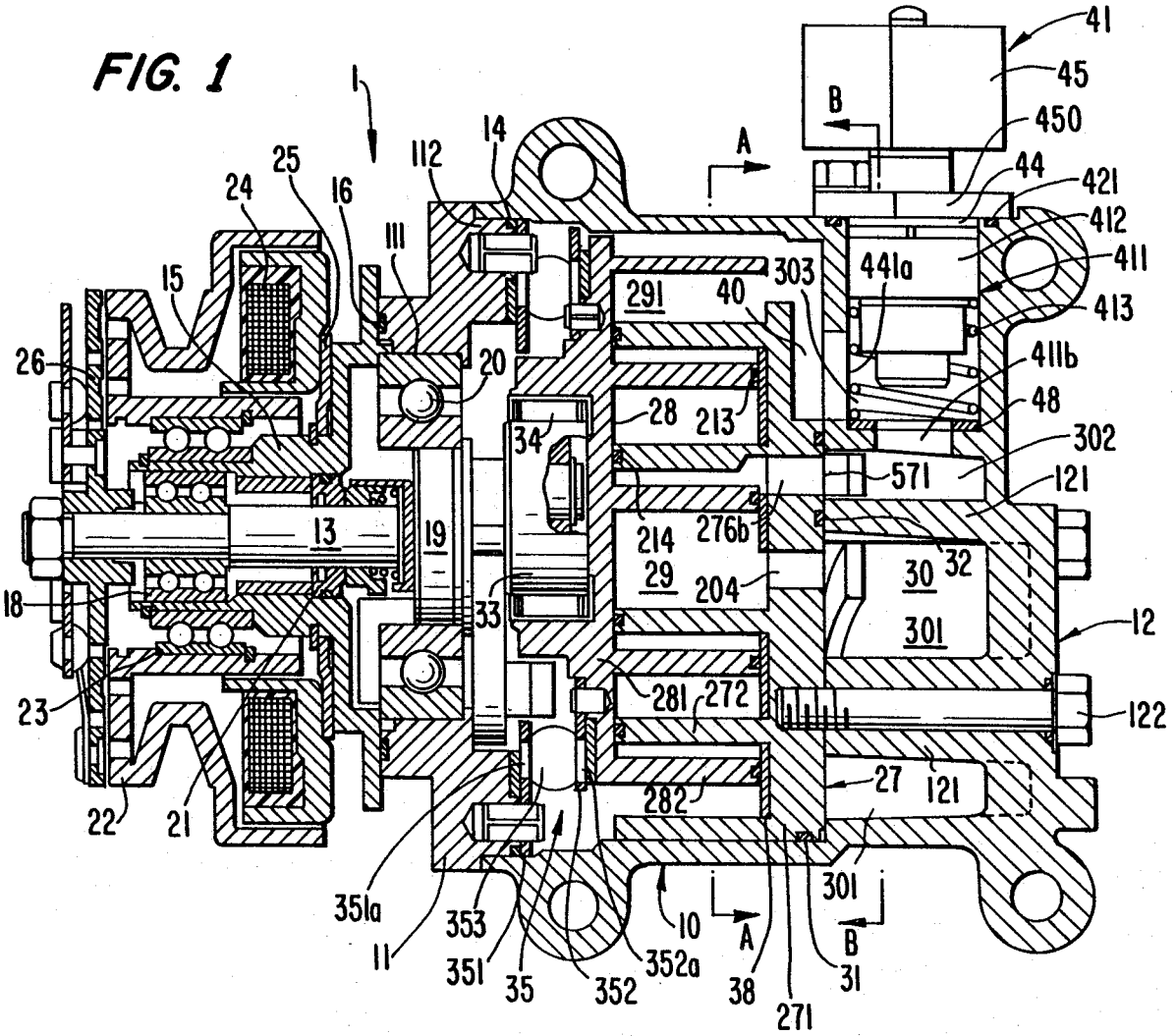
FIG. 1 is a vertical longitudinal sectional view of a scroll type compressor in accordance with a first embodiment of the invention.

Referring to FIG. 1, a scroll type refrigerant compressor 1 in accordance with an embodiment of the present invention is shown. Compressor 1 includes compressor housing 10 having front end plate 11 and cup shaped casing 12 which is attached to an end surface of front end plate 11. Opening 111 is formed in the center of front end plate 11 for penetration or passage of drive shaft 13. Annular projection 112 is formed in a rear end surface of front end plate 11. Annular projection 112 faces cup shaped casing 12 and is concentric with opening 111. An outer peripheral surface of annular projection 112 extends into an inner wall of the opening of cup shaped casing 12. Thus, the opening of cup shaped casing 12 is covered by front end plate 11. O-ring 14 is placed between the outer peripheral surface of annular projection 112 and the inner wall of the opening of cup shaped casing 12 to seal the mating surfaces of front end plate 11 and cup shaped casing 12.

Annular sleeve 15 projects from the front end surface of front end plate 11 to surround drive shaft 13 and define a shaft cavity. In the embodiment shown in FIG. 1, sleeve 15 is formed separately from front end plate 11. Therefore, sleeve 15 is fixed to the front end surface of front end plate 11 by screws (not shown). O-ring 16 is disposed between the end surface of sleeve 15 and the front surface of front end plate 11 to seal the mating surfaces of front end plate 11 and sleeve 15. Alternatively, sleeve 15 may be formed integral with front end plate 11.

Drive shaft 13 is rotatably supported by sleeve 15 through bearing 18 located within the front end of sleeve 15. Drive shaft 13 has disk shaped rotor 19 at its inner end which is rotatably supported by front end plate 11 through bearing 20 located within opening 111 of front end plate 11. Shaft seal assembly 21 is coupled to drive shaft 13 within the shaft seal cavity of sleeve 15.

Pulley 22 is rotatably supported by bearing 23 which is carried on the outer surface of sleeve 15. Electromagnetic coil 24 is fixed about the outer surface of sleeve 15 by support plate 25 and is received in an annular cavity of pulley 22. Armature plate 26 is elastically supported on the outer end of drive shaft 13 which extends from sleeve 15. Pulley 22, magnetic coil 24 and armature plate 26 form a magnetic clutch. In operation, drive shaft 13 is driven by an external power source, for example the engine of automobile, through a rotation transmitting device such as above explained magnetic clutch.

A number of elements are located within the inner chamber of cup shaped casing 12 including fixed scroll 27, orbiting scroll 28, a driving mechanism for orbiting scroll 28 and rotation preventing/ thrust bearing device 35 for orbiting scroll 28. The inner chamber of cup shaped casing 12 is formed between the inner wall of cup shaped casing 12 and the rear end surface of front end plate 11.

Fixed scroll 27 includes circular end plate 271 and wrap or spiral element 272 affixed to or extending from one end surface of end plate 271. Fixed scroll 27 is fixed within the inner chamber of cup shaped casing 12 by screws 122 screwed into end plate 271 from outside of cup shaped casing 12. Circular end plate 271 of fixed scroll 27 partitions the inner chamber of cup shaped casing 12 into two chambers, such as front chamber 29 and rear chamber 30. Seal ring 31 is disposed within a circumferential groove of circular end plate 271 to form a seal between the inner wall of cup shaped casing 12 and the outer surface of circular end plate 271. Spiral element 272 is located within front chamber 29.

Figure 3:
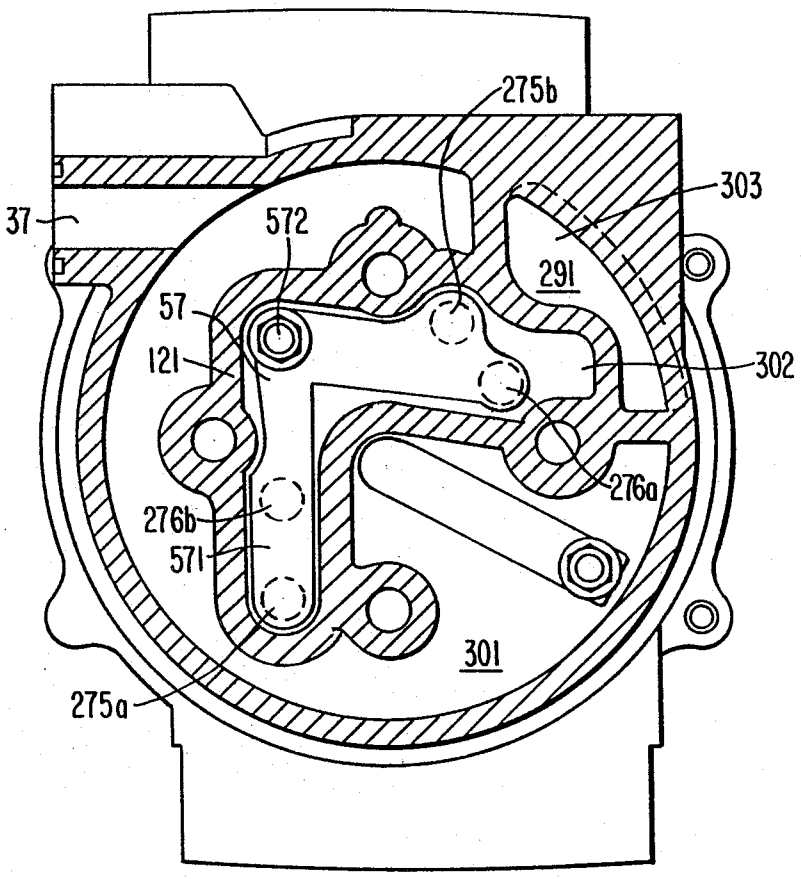
FIG. 3 is a sectional view taken substantially along line B—B of FIG. 1.

Annular partition wall 121 axially projects from the inner end surface of cup shaped casing 12. Seal ring 32 is located between the axial end surface of partition wall 121 and the end surface of circular end plate 271 to seal the contacting surfaces of circular end plate 271 and partition wall 121. As best seen in FIG. 3, partition wall 121 divides rear chamber 30 into discharge chamber 301, intermediate pressure chamber 302 and suction passage chamber 303 formed at an outer peripheral portion of rear chamber 30.

Orbiting scroll 28, which is located in front chamber 29 includes circular end plate 281 and wrap or spiral element 282 affixed to or extending from one end surface of circular end plate 281. Spiral elements 272 and 282 interfit at an angular offset of 180° and at a predetermined radial offset. Spiral elements 272 and 282 define at least one pair of sealed off fluid pockets between their interfitting surfaces. Orbiting scroll 28 is rotatably supported by bushing 33 through bearing 34 placed on the outer peripheral surface of bushing 33. Bushing 33 is connected to an inner end of disk shaped portion 19 at a point radially offset or eccentric of the axis of drive shaft 13. While orbiting scroll 28 orbits, its rotation is prevented by rotation preventing/thrust bearing device 35 which is placed between the inner end surface of front end plate 11 and the end surface of circular end plate 281. Rotation preventing/thrust bearing device 35 includes fixed ring 351 attached on the inner end surface of front end plate 11, orbiting ring 352 attached on the end surface of circular end plate 282, and a plurality of bearing elements, such as balls 353, placed between pockets **351*a*, 352*a* formed by rings 351, 352. The rotation of orbiting scroll 28 during orbital motion is prevented by the interaction of balls 353 with rings 351, 352. Also, the axial thrust load from orbiting scroll 28 is supported on front end plate 11 through balls 353**.

Figure 2:
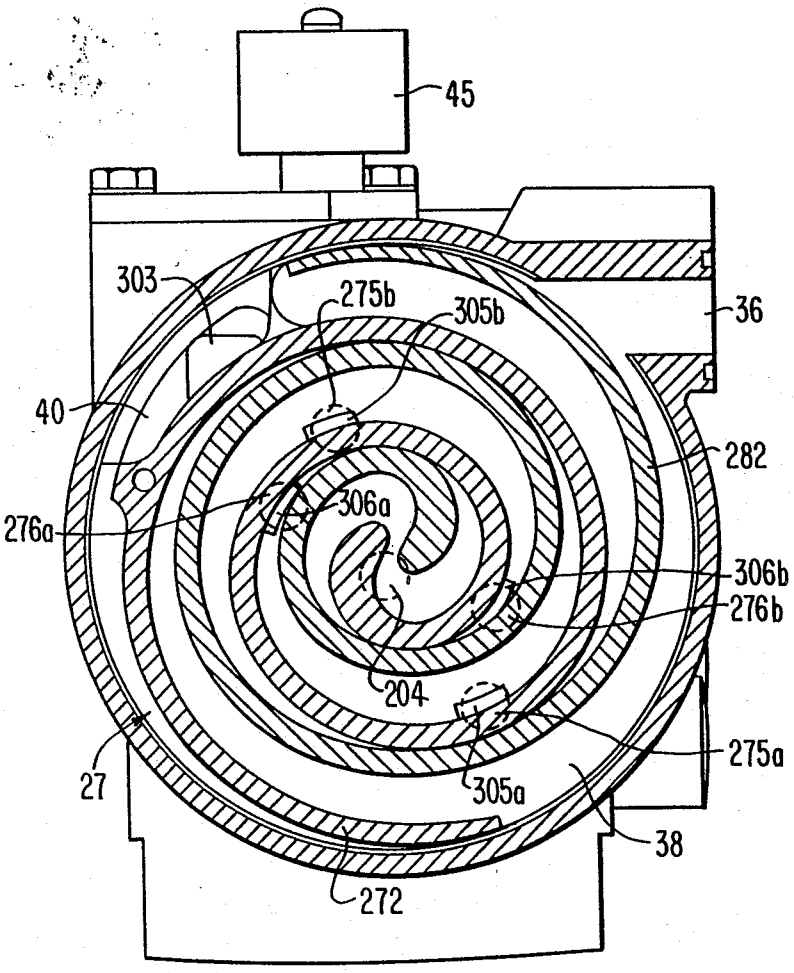
FIG. 2 is a sectional view taken substantially along line A—A of FIG. 1.

Referring to FIGS. 2 and 3, cup shaped casing 12 has fluid inlet port 36 and fluid outlet port 37 for connecting the compressor to an external fluid circuit. Fluid from the external fluid circuit is introduced into front chamber 29 of the compressor through fluid inlet port 36. Fluid in front chamber 29 is taken into the fluid pockets through open spaces between the outer terminal end of one of the spiral elements 272, 282 and the outer wall surface of the other spiral element. The entrance to these fluid pockets or open spaces sequentially open or close during the orbital motion of orbital scroll 28. When the entrance to the fluid pockets are open, fluid to be compressed flows into these pockets but no compression occurs. When the entrances are closed, thereby sealing off the fluid pockets, no additional fluid flows into the pockets and compression begins. Since the location of the outer terminal end of each spiral element 272, 282 is at the final involute angle, the location of the fluid pockets is directly related to the final involute angle.

The final involute angle ($\phi$end) at the end of spiral element 272 of fixed scroll 27 is greater than $4\pi$. Two pairs of holes **275*a*, 275*b* and 276*a*, 276*b* are formed in end plate 271 of fixed scroll 27. Both the pair of holes 275*a* and 275*b*, and the pair of holes 276*a* and 276b are placed at symmetrical positions so that an axial end surface of spiral element 282 of orbiting scroll 28 simultaneously crossed over holes 275*a*, 275*b* or 276*a*, 276*b*. Holes 275*a*, 275*b* and 276*a*, 276*b* communicate between the fluid pockets in front chamber 29 and intermediate pressure chamber 302 of rear chamber 30 as best shown in FIG. 1. Hole 275*a* is placed at a position defined by involute angle $\phi_1$ and opens along the inner wall side of spiral element 272. Hole 275*b* is placed at a position defined by the involute angle ($\phi_1 - \pi$) and opens along the outer wall side of spiral element 272. Hole 276*a* is placed at a position defined by involute angle slightly larger ($\phi_1 - \pi$) and opens along the inner wall side of spiral element 272. Hole 276b is placed at a position defined by involute angle slightly larger ($\phi_1 - 2\pi$) and opens along the outer wall side of spiral element 272. The preferred area within which to place first hole 275a**, as defined by involute angle is given by $\phi$ end $> \phi_1 > \phi$end-$2\pi$.

Referring to FIG. 3, a control device, such as valve member 57 having valve plate 571, is attached by fastener 572 to the end surface of end plate 271 and extends over holes 275a, 275b, 276a and 276b. Valve plate 571 is made of spring type material so that the inherent spring of valve plate 571 pushes it against the opening of respective holes 275a, 275b, 276a and 276b to close each hole.

End plate 271 of fixed scroll 27 also includes communicating channel or hole 40 at the outer side portion of the terminal end of spiral element 272. Communicating channel 40 connects suction chamber 291 to suction passage chamber 303. Control mechanism 41, which controls the opening and closing of communicating channel 40, is located in suction passage chamber 303. Control mechanism 41, which is a two-way valve, includes cylinder 411, piston 412 slidably disposed within cylinder 411, and coil spring 413 disposed between the lower portion of piston 412 and washer 48 on the bottom of cylinder 411 to support piston 412. First opening 411a is connected with suction chamber 291 through communicating channel 40. A bottom portion of cylinder 411 communicates with intermediate pressure chamber 302 through second opening 411b and the upper portion of cylinder 411 is provided with plate 450 having aperture (not shown) which connects cylinder 411 with discharge chamber 301 through capillary tubing (not shown). O-ring seal 421 is disposed between upper portion of cylinder 411 and plate 450 to prevent leakage of high pressure gas. Front end surface of the plate 450 is provided with magnetic valve 45. Piston ring 44 is placed on the upper portion of piston 412 to prevent leakage of high pressure gas between cylinder 411 and piston 412.

Compressor 1, including adjustment of its displacement operates in the following manner. When the orbital motion of the orbiting scroll 28 is begun by rotation of a drive shaft 13, fluid is taken into suction chamber 291 through fluid inlet port 36, and thereafter into the fluid pockets of the spiral wraps 272, 282.

When the aperture through plate 450 is opened by operation of magnetic valve 45, the high pressure gas in discharge chamber 301 is introduced into the upper portion of cylinder 411 through capillary tubing (not shown). At that time, if the recoil strength of coil spring 413 is selected to be less than the pressure force of the high pressure gas, piston 412 will be pushed down by the pressure of the high pressure gas. Furthermore, second opening 411b of cylinder 411 is closed by piston 412, i.e., communication between intermediate pressure chamber 302 and suction chamber 291 is blocked. Thus, the fluid in the fluid pockets moves to the center of the spiral wraps because of the orbital motion of orbiting scroll 28, with a resultant volume reduction and compression, and is discharged into discharge chamber 301 through discharge hole 204 in end plate 271.

At the initial stage of operation described above, the pressure in the fluid pockets increases above the pressure in intermediate pressure chamber 302. Therefore, valve plate 571 operates to open holes 275a, 275b, 276a and 276b by virtue of the pressure difference between the fluid pockets and intermediate pressure chamber 302. With valve plate 571 open, the fluid in the fluid pockets leaks back to intermediate pressure chamber 302 through holes 275a, 275b, 276a and 276b. This leakage continues until the pressure in the fluid pockets is equal to the pressure in intermediate pressure chamber 302. When pressure equalization occurs, holes 275a, 275b, 276a and 276b are closed by the spring tension in valve plate 571 so that compression operates normally and the displacement volume of the sealed off fluid pockets is the same as the displacement volume when the terminal end of each respective spiral wrap 272, 282 first contacts the other spiral wrap.

In this latter full compression or displacement condition, if the aperture through plate 450 is closed by operation of magnetic valve 45, the flow of the high pressure gas to the upper portion of cylinder 411 is prevented. The high pressure gas already contained in the sealed off space between the upper portion of cylinder 411 and piston 412 then leaks to suction chamber 291 through a gap in piston ring 44. Piston 412 then is pushed by the recoil strength of coil spring 413 to open second opening 411b of cylinder 411. Fluid communication between intermediate chamber 302 and suction chamber 291 is established and, thus, the compression ratio of the compressor is reduced.

Seal element 213 is located in groove 283 in the axial end surface of spiral element 282 and forms an axial seal between the spiral element 282 and the front end surface of the end plate 271. The axial end surface of spiral element 272 is also provided with a seal element 214 which forms an axial seal between the spiral element 272 and the front end surface of the end plate 281. An anti-wear plate 38 is disposed on the front end surface of the end plate 271 to prevent friction between seal element 213 and the front end surface of end plate 271. Referring to FIG. 2, an anti-wear plate 38 is provided with four rectangular cut-out portions 305a, 305b, 306a and 306b adjacent to holes 275a, 275b, 276a and 276b respectively.

Figure 4:
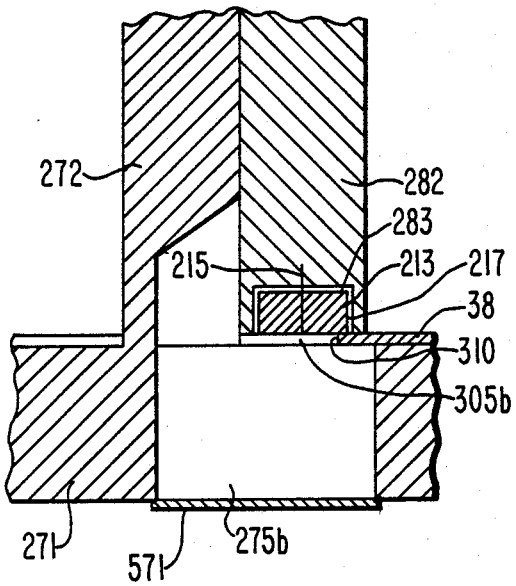
FIG. 4 is a enlarged partially sectional view in accordance with the first embodiment, illustrating the location of the seal element and anti-wear plate when the spiral element of orbiting scroll completely overlaps one of the holes.
Figure 5:
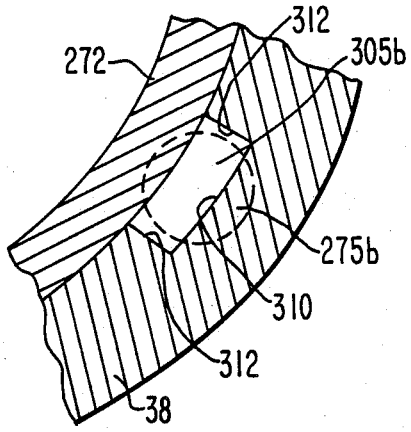
FIG. 5 is a schematic view in accordance with the first embodiment, illustrating the shape of cut-out portion of anti-wear plate.
Figure 8:
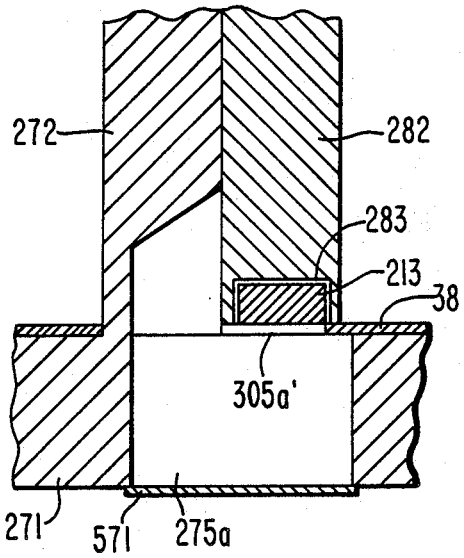
FIG. 8 is a enlarged partially sectional view similar to FIG. 4 illustrating an earlier test version of an anti-wear plate used in a variable displacement compressor.
Figure 9:
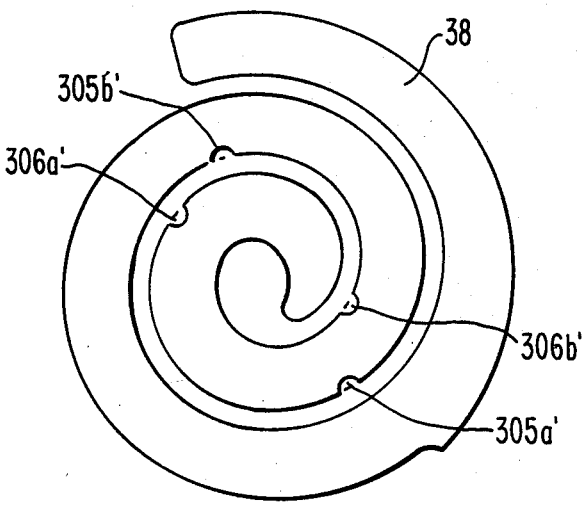
FIG. 9 is a elevational view of the anti-wear plate illustrated in FIG. 8.
Figure 10:
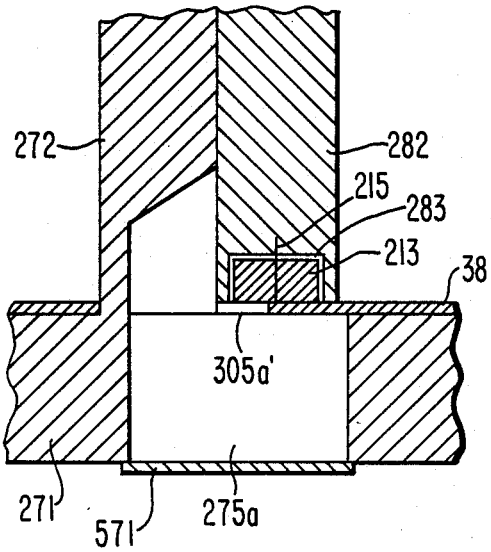
FIG. 10 is a enlarged partially sectional view similar FIG. 4 illustrating another test version of an anti-wear plate used in a variable displacement compressor.

Referring to FIGS. 4 and 5, one cut-out portion 305b is shown in enlarged detail to illustrate the suitable shape (width and length in the rectangular form) of the cut-out which solves the above-mentioned problems in the cut-outs illustrated in FIGS. 8, 9 and 10. The shape of the remaining cut-out portions 305a, 306a and 306b would be similarly configured. Thus, in each of the embodiments, the cut-out portions of the anti-wear plate have an area and configuration which leaves a sufficient amount of the anti-wear plate overlapping a respective hole so that the seal element is prevented from bending into the respective hole at the operative compression pressure at that hole, while at the same time minimizing the pressure loss at the respective hole when fluid passes through the hole.

In the embodiment illustrated in FIGS. 4 and 5, each cut-out portion has a longitudinal edge 310 which extends generally in the direction of the length of spiral element 272. Longitudinal edge 310 extends completely across hole 275b. In order to assure that seal element 213 does not bend into hole 275b, longitudinal edge 310 is located, along its entire extent, inside the outermost edge 217 of seal element 213 when spiral element 282 completely overlaps hole 275b to thereby provide support and resistance to bending for tip seal 213. Edge 217 is referred to as outermost in reference to the wall of spiral element 272 at the particular hole 275a, 275b, 276a or 276*b* which spiral element 282 is overlapping. The terms inside and outside are likewise in reference to the wall of spiral element 272 adjacent a respective hole 275*a*, 275*b*, 276*a*, 276*b*. However, in order to minimize the pressure loss caused by covering a portion of hole 275*b* with anti-wear plate 38, longitudinal edge 310, along its entire extent, is outside the radial center 215 of seal element 213, i.e. outside the center of the width of seal element 213.

In the embodiment illustrated in FIGS. 4 and 5, hole cut out portion 305*b* has a rectangular shape so that longitudinal edge 310 is generally linear and forms the length of the rectangle, while spaced edges 312 of cut out portion 305*b* are perpendicular to edge 310 and form the width of the rectangle. Edges 312 are located outside hole 275*b* so that the only edge of hole 305*a* which extends across hole 275*b* is located between center 215 and outermost edge 217 of seal element 213. The edge of 305a can take on a shape other than a side of a rectangular, e.g. semi-circular, trapezoidal, etc., as long as the condition for assuring support for the seal element without undue pressure loss is met, i.e. the entire extent of the edge of hole 305*a* is located between center 215 and outermost edge 217.

Figure 6:
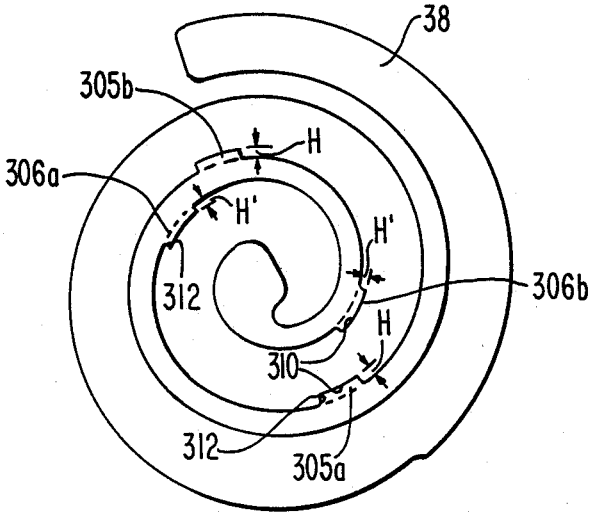
FIG. 6 is a elevational view of an anti-wear plate in accordance with the invention.

Referring to FIG. 6, an anti-wear plate 38 in accordance with the present invention is shown, which illustrates that longitudinal edge 310 need not be located at the same location with respect to seal element 213 at all locations along the length of spiral element 272. The width of edges 312 of cut-out portions 306*a* and 306*b*, adjacent to holes 276*a* and 276*b*, which are located near the scroll center is indicated as H'. The width of edges 312 of cut-out portions 305*a* and 305*b*, adjacent to holes 275*a* and 275*b*, which are located further from the scroll center, is as indicated as H. H is longer H' in order to located longitudinal edge 310 closer to center 215 at holes 276*a* and 276*b*. Locating longitudinal edge 310 of cut-out portions 306*a* and 306*b* closer to center 215 provides greater resistance to the bending of seal element 213 at an area where seal element 213 is subjected to higher fluid pressure, i.e. at an area closer to the center of the scrolls. Longitudinal edge 310 of cut-out portions 306*a* and 306*b*, however, is still kept outside center 215 of seal element 213.

Figure 7:
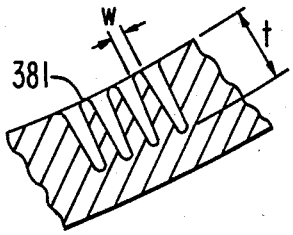
FIG. 7 is a enlarged view of a portion of an anti-wear plate in accordance with another embodiment of the invention.

Referring to FIG. 7, an anti-wear plate 38 in accordance with another embodiment of the present invention is shown. Each cut-out portion has the configuration of a plurality of spaced teeth 381 extending toward the inner edge of spiroidal anti-wear plate 38. The area of the spacing between teeth 381 is selected to assure that teeth 381 have sufficient area to support (prevent bending of) seal element 213 for the given operative pressure at a respective hole 275, 276, while at the same time minimizing pressure loss at the respective hole during fluid passage through the hole. The accomplish this objective, the width "w", length "t" or number of the teeth can be adjusted. Length "t" of teeth 381 is preferably set so that the distal end of teeth 381 align with the inner spiral edge of anti-wear plate 38.

This invention has been described in detail in connection with the illustrated preferred embodiments. These embodiments, however, are merely for example only and the invention is not restricted thereto. It will be easily understood by those skilled in the art that other variations and modifications can be easily made within the scope of this invention, as defined by the appended claims.

What is claimed is:

1. In a scroll type fluid compressor including a housing having a fluid inlet port and a fluid outlet port, a fixed scroll fixedly disposed within said housing and having an end plate from which a first spiral wrap extends into the interior of said housing, an orbiting scroll having an end plate from which a second spiral wrap extends, said first and second wraps interfitting at an angular and radial offset to form a plurality of line contacts which define at least one pair of sealed off fluid pockets, a driving mechanism operatively connected to said orbiting scroll to effect the orbital motion of said orbiting scroll, rotation preventing means for preventing the rotation of said orbiting scroll during orbital motion whereby the volume of the fluid pockets changes during orbital motion to compress the fluid in the pockets and the compressed fluid from a central fluid pocket formed by said scrolls is discharged through an outlet aperture formed in one of said end plates, displacement adjusting means including at least one pair of holes formed through said end plate of one of said scrolls to form a fluid channel between the pair of sealed off fluid pockets and the opposite side of said end plate of said one scroll from its respective wrap, said pair of holes located at symmetrical locations along said respective wrap so that the wrap on the other of said scrolls simultaneously crosses over both of said holes during orbital motion of said orbiting scroll, control means for controlling flow of fluid through said at least one pair of holes, the axial end surface at least of the wrap of the other of said scrolls being provided with a seal element having a predetermined width and extending along the length of said axial end surface, the improvement comprising:

an anti-wear plate being disposed on the front end surface of the end plate of said one of said scrolls, said anti-wear plate having cut-out portions adjacent each of said holes, each of said cut-out portions of said anti-wear plate having a longitudinal edge extending completely across the adjacent hole and, in the relative disposition of said scrolls when the wrap of said other of said scrolls completely overlaps a respective hole, said longitudinal edge of the adjacent cut-out portion located in the area between the center of the width of said seal element and the outermost edge of said seal element with respect to the portion of the wrap along which said respective hole is located.

2. The scroll type compressor of claim 1 wherein said at least one pair of holes includes a first pair of said holes and a second pair of said holes located closer to the center of said scrolls than said first pair of said holes.

3. The scroll type compressor of claim 2 wherein said longitudinal edge of said cut-out portions located adjacent said second pair of said holes is located closer to the center of said seal element than the longitudinal edge of said cut-outs located adjacent said first pair of said holes.

4. The scroll type compressor of claim 1, 2 or 3 wherein said one of said scrolls is said fixed scroll and said other of said scrolls is said orbiting scroll.

5. The scroll type compressor of claim 4 wherein said cutout portions have a generally rectangular configuration.

6. In a scroll type fluid compressor including a housing having a fluid inlet port and a fluid outlet port, a fixed scroll fixedly disposed within said housing and having an end plate from which a first spiral wrap extends into the interior of said housing, an orbiting scroll having an end plate from which a second spiral wrap extends, said first and second wraps interfitting at an angular and radial offset to form a plurality of line contacts which define at least one pair of sealed off fluid pockets, a driving mechanism operatively connected to said orbiting scroll to effect the orbital motion of said orbiting scroll, rotation preventing means for preventing the rotation of said orbiting scroll during orbital motion whereby the volume of the fluid pockets changes during orbital motion to compress the fluid in the pockets and the compressed fluid from a central fluid pocket formed by said scrolls is discharged through an outlet aperture formed in one of said end plates, displacement adjusting means including at least one pair of holes formed through said circular end plate of one of said scrolls to form a fluid channel between the pair of sealed off fluid pockets and the opposite side of said end plate of said one scroll from its respective wrap, said pair of holes located at symmetrical locations along said respective wrap so that the wrap of the other of said scrolls simultaneously crosses over both of said holes during orbital motion of said orbiting scroll, control means for controlling the flow of fluid through said at least one pair of holes, the axial end surface of at least the wrap of the other of said scrolls including a groove formed therein, a seal element disposed within said groove and having a predetermined width and extending along the length of said axial end surface, the improvement comprising:

an anti-wear plate disposed on the front end surface of the end plate of said one of said scrolls, said anti-wear plate having cut-out portoins extending over the adjacent hole and having a predetermined area and configuration to dispose a sufficient area of said anti-wear plate over the hole and beneath said seal element such that less than half of the surface area of said seal element disposed over said hole is covered by said anti-wear plate when the other of said scrolls simultaneously crosses over both of said holes.

7. The scroll compressor of claim 6 wherein each of said cut-out portions of said anti-wear plate has a longitudinal edge extending completely across an adjacent hole and, in the relative disposition of said scrolls when the wrap of the other of said scrolls completely overlaps a respective hole, said longitudinal edge of the adjacent cut-out portion being located in the area between the center of the width of said seal element and the outermost edge of said seal element with respect to the portion of the wrap along which the respective hole is located.

8. The scroll type compressor of claim 6 wherein said at least one pair of holes includes a first pair of said holes and a second pair of said holes located closer to the center of said scrolls than said first pair of said holes.

9. The scroll type compressor of claim 7 wherein said at least one pair of holes includes a first pair of said holes and a second pair of said holes located closer to the center of said scrolls than said first pair of said holes.

10. The scroll type compressor of claim 9 wherein said longitudinal edge of said cut-out portions located adjacent said second pair of said holes is located closer to the center of said seal element than the longitudinal edge of said cut-outs located adjacent said first pair of said holes.

11. The scroll type compressor of claim 6 wherein said one of said scrolls is said fixed scroll and said other of said scrolls is said orbiting scroll.

12. In a scroll type fluid compressor including a housing having a fluid inlet port and a fluid outlet port, a fixed scroll fixedly disposed within said housing and having an end plate from which a first wrap extends into the interior of said housing, an orbiting scroll having an end plate from which a second wrap extends, said first and second wraps interfitting at an angular and radial offset to form a plurality of line contacts which define at least one pair of sealed off fluid pockets, a driving mechanism operatively connected to said orbiting scroll to effect the orbital motion of said orbiting scroll, rotation preventing means for preventing the rotation of said orbiting scroll during orbital motion whereby the volume of the fluid pockets changes during orbital motion to compress the fluid in the pockets and the compressed fluid from a central fluid pocket formed by said scrolls is discharged through an outlet aperture formed in one of said end plates, displacement adjustment means including at least one pair of holes formed through said end plate of one of said scrolls to form a fluid channel between the pair of sealed off fluid pockets and the opposite side of said end plate of said one scroll from its respective wrap, said pair of holes being located at symmetrical locations along said respective wrap so the wrap of the other of said scrolls simultaneously crosses over both of said holes during orbital motion of said orbiting scroll, control means for controlling flow of fluid through said at least one pair of holes, the axial end surface at least of the wrap of the other of said scrolls being provided with a seal element having a predetermined width and extending along the length of said axial end surface, the improvement comprising:

an anti-wear plate being disposed on the front end surface of the end plate of said one of said scrolls, said anti-wear plate having cut-out portions adjacent each of said holes, each of said cutout portions being formed in the configuration of a plurality of spaced teeth.

13. The scroll compressor of claim 12 wherein said teeth have distal ends in substantial alignment with the inner edge of said anti-wear plate located adjacent said one of said wraps.

14. The scroll type compressor of claim 12 or 13 wherein said at least one pair of holes includes a first pair of said holes and a second pair of said holes located closer to the center of said scrolls than said first pair of said holes.

15. The scroll compressor of claim 14 wherein the area of the spaces between said teeth is greater in said cut-out portions located adjacent said first pair of said hole than in said cut-out portions located adjacent said second pair of said holes.

16. The scroll type compressor of claim 12 or 13 wherein said one of said scrolls is said fixed scroll and said other of said scrolls is said orbiting scroll.

17. In a scroll type fluid compressor including a housing having a fluid inlet port and a fluid outlet port, a fixed scroll fixedly disposed within said housing and having an end plate from which a first spiral wrap extends into the interior of said housing, an orbiting scroll having an end plate from which a second spiral wrap extends, said first and second wraps interfitting at an angular and radial offset to form a plurality of line contacts which define at least one pair of sealed off fluid pockets, a driving mechanism operatively connected to said orbiting scroll to effect the orbital motion of said orbiting scroll, rotation preventing means for preventing the rotation of said orbiting scroll during orbital motion whereby the volume of the fluid pockets changes during orbital motion to compress the fluid in the pockets and the compressed fluid from a central fluid pocket formed by said scrolls is discharged through an outlet aperture formed in one of said end plates, displacement adjusting means including at least one pair of holes formed through said end plate of one of said scrolls to form a fluid channel between the pair of sealed off fluid pockets and the opposite side of said end plate of said one scroll from its respective wrap, said pair of holes located at symmetrical locations along said respective wrap so that the wrap of the other of said scrolls simultaneously crosses over both of said holes during orbital motion of said orbiting scroll, control means for controlling flow of fluid through said at least one pair of holes, the axial end surface at least of the wrap of the other of said scrolls including a groove formed therein, a seal element disposed within said groove and having a predetermined width and extending substantially along the length of said axial end surface, the improvement comprising:

an anti-wear plate disposed on the front end surface of the end plate of said one of said scrolls, said anti-wear plate having cut-out portions adjacent each of said holes, each of said cutout portions of said anti-wear plate having a longitudinal edge extending completely across the adjacent hole and, in the relative disposition of said scrolls when the wrap of said other of said scrolls completely overlaps a respective hole, said longitudinal edge of the adjacent cut-out portion located in the area between the center of the width of said seal element and the outermost edge of said element with respect to the portion of the wrap along which said respective hole is located.

18. In scroll type fluid compressor including a housing having a fluid inlet port and a fluid outlet port, a fixed scroll disposed within said housing and having an end plate from which a first spiral wrap extends into the interior of said housing, an orbiting scroll having an end plate from which a second spiral wrap extends, said first and second wraps interfitting at an angular and radial offset to form a plurality of line contacts which define at least one pair of sealed off fluid pockets, a driving mechanism operatively connected to said orbiting scroll to effect the orbital motion of said orbiting scroll, rotation preventing means for preventing the rotation of said orbiting scroll during orbital motion whereby the volume of the fluid pockets changes during orbital motion to compress the fluid in the pockets and the compressed fluid from a central fluid pocket formed by said scrolls is discharged through an outlet aperture formed in one of said end plates, displacement adjusting means including at least one pair of holes formed through said end plates of one of said scrolls to form a fluid channel between the pair of sealed off fluid pockets and the opposite side of said end plate of said one scroll from its respective wrap, said pair of holes located at symmetrical locations along said respective wrap so that the wrap of the other of said scrolls simultaneously crosses over both of said holes during orbital motion of said orbiting scroll, control means for controlling flow of fluid through said at least one pair of holes, the axial end surface at least of the wrap of the other of said scrolls including a groove formed therein, a seal element disposed within said groove and having a predetermined width and extending substantially along the length of said axial end surface, the improvement comprising:

an anti-wear plate disposed on the front end surface of the end plate of said one of said scrolls, said anti-wear plate having cut-out portions adjacent each of said holes, each of said cut-out portions of said anti-wear plate having a longitudinal edge extending completely across the adjacent hole and, in the relative disposition of said scrolls when the wrap of said other of said scrolls completely overlaps a respective hole, the longitudinal edge of the adjacent cut-out portion is located in the area between the axial center of width of said groove, and the outer-most edge of said groove with respect to the portion of the wrap along which said respective hole is located.

* * * * *

UNITED STATES PATENT AND TRADEMARK OFFICE

CERTIFICATE OF CORRECTION

PATENT NO. : 4,890,987

DATED : January 2, 1990

INVENTOR(S) : Tadashi Sato and Atsushi Mabe

It is certified that error appears in the above-identified patent and that said Letters Patent is hereby corrected as shown below:

Column 2, line 43, "282" should be --272—;

Column 9, line 16, "305a" should be —305b—;

Column 9, line 19, "305a" should be --305b—;

Column 9, line 23, delete "hole 305a" and insert —cut out portion 305b—; and

Column 11, line 32, "portoins" should be —portions—.

Signed and Sealed this

Twenty-fifth Day of December, 1990

*Attest:*

HARRY F. MANBECK, JR.

*Attesting Officer*

*Commissioner of Patents and Trademarks*